United States Patent [19]

Wittrisch

[11] Patent Number: 4,570,709

[45] **Date of Patent: * Feb. 18, 1986**

[54] METHOD AND DEVICE FOR EFFECTING, BY MEANS OF SPECIALIZED TOOLS, SUCH OPERATIONS AS MEASUREMENTS IN HIGHLY INCLINED TO THE VERTICAL OR HORIZONTAL WELL PORTIONS

[75] Inventor: Christian Wittrisch, Rueil-Malmaison, France

[73] Assignee: Institut Francais du Petrole, Rueil-Malmaison, France

[ * ] Notice: The portion of the term of this patent subsequent to Jul. 3, 2001 has been disclaimed.

[21] Appl. No.: 596,986

[22] Filed: Apr. 5, 1984

Related U.S. Application Data

[63] Continuation-in-part of Ser. No. 357,519, Mar. 12, 1982, Pat. No. 4,457,370.

[30] Foreign Application Priority Data

Mar. 13, 1981 [FR] France ..... 81 05271

[51] Int. Cl.[4] ..... E21B 23/08; E21B 43/112; E21B 47/00

[52] U.S. Cl. ..... 166/250; 166/65.1; 166/378; 166/383

[58] Field of Search ..... 166/50, 65 R, 66, 77, 166/78, 113, 153, 155, 156, 233, 250, 254, 255, 378, 383, 385; 175/40, 45, 50, 61, 62, 104, 317, 318

[56] References Cited

U.S. PATENT DOCUMENTS

| | | | |
|---|---|---|---|
| 2,726,848 | 12/1955 | Montgomery et al. | 175/40 |
| 3,550,684 | 12/1970 | Cubberly, Jr. | 166/250 |
| 3,601,196 | 8/1971 | Childers | 166/250 |
| 3,976,347 | 8/1976 | Cooke, Sr. et al. | 166/65 R |
| 4,062,551 | 12/1977 | Base | 166/242 |
| 4,166,500 | 9/1979 | McPhee | 166/250 |
| 4,168,747 | 9/1979 | Youmans | 166/250 |
| 4,286,676 | 9/1981 | Nguyen et al. | 175/74 |
| 4,319,240 | 3/1982 | Stone et al. | 125/40 |
| 4,349,072 | 9/1982 | Escaron et al. | 166/250 |
| 4,457,370 | 7/1984 | Wittrisch | 166/378 |

*Primary Examiner*—George A. Suchfield
*Assistant Examiner*—William P. Neuder
*Attorney, Agent, or Firm*—Millen and White

[57] ABSTRACT

A method for effecting logging or servicing operations in a predetermined zone of a well, following an initial portion thereof, comprising fastening a logging or servicing tool body at the end of a string of rods lowered into the well, said tool body being provided with an electric male connector, lowering at the end of an electric transmission cable, from the surface, a female connector adapted to fit the male connector, coupling said female and male connectors by the action of a force generated at least partly by the pressure of a fluid pumped through the string of rods, supplying electric power, through said transmission cable and said connectors, to said logging or servicing tool for its operation in said predetermined zone, and with rotating means located between the string of rods and said tool, rotating the tool without rotating the whole string of rods.

9 Claims, 19 Drawing Figures

FIG.1
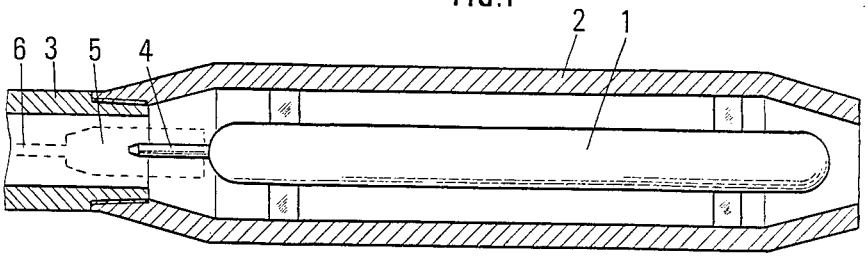
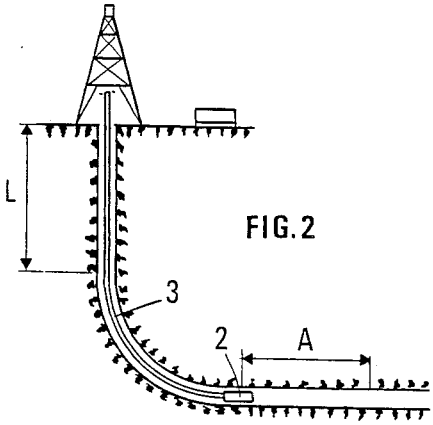
FIG.2
FIG.3
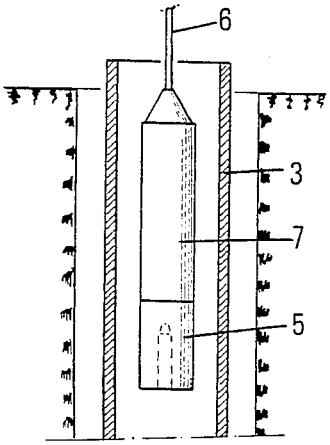
FIG.4
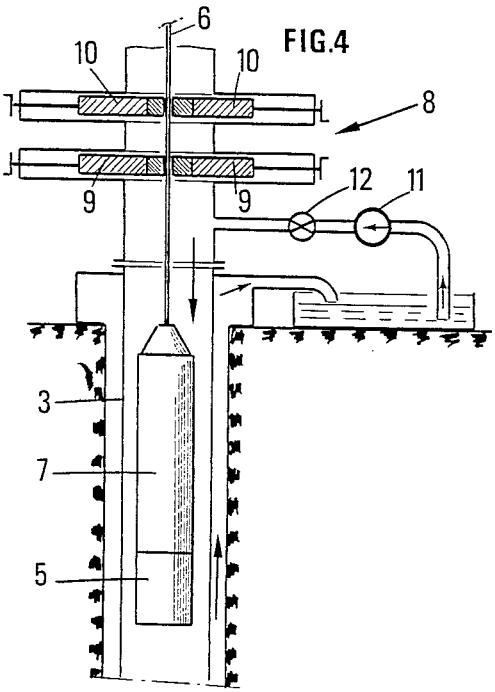
FIG.5
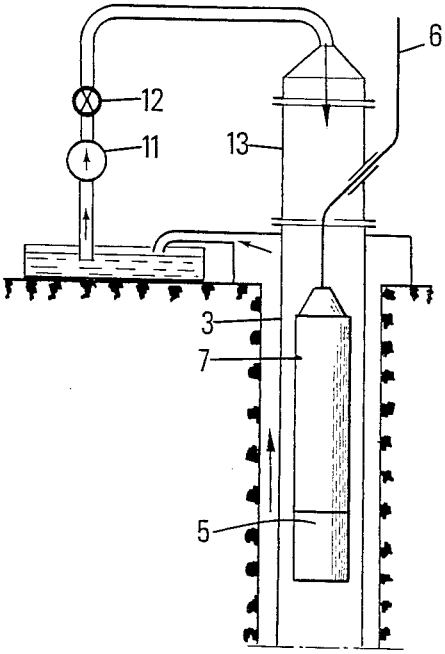

METHOD AND DEVICE FOR EFFECTING, BY MEANS OF SPECIALIZED TOOLS, SUCH OPERATIONS AS MEASUREMENTS IN HIGHLY INCLINED TO THE VERTICAL OR HORIZONTAL WELL PORTIONS

This application is a continuation in part of copending application Ser. No. 357,519 filed Mar. 12, 1982, and now U.S. Pat. No. 4,457,370, the entire disclosure of application Ser. No. 357,519 being specifically incorporated by reference herein.

BACKGROUND OF THE INVENTION

This invention concerns a method and a device for effecting, in a portion of a well, such operations as measurements by means of specialized tools. The portion of the well can be deviated, highly inclined to a vertical line or horizontal. The portion can also be vertical. In this case the invention is particularly advantageous when the portion is located in or after a zone wherein the penetration of the tool is difficult. For instance, if this zone is a deviated, highly inclined or horizontal zone, or if said zone is occluded with debris.

According to the prior art, specialized tools for effecting such operations as, for example, measurements, are secured to the end of a carrying wireline and moved into the well by the action of gravity without substantial difficulty as long as the inclination of the bore-hole with respect to a vertical line does not exceed about 45°. Beyond this limit, the displacement of the tools is only possible when the profile of the bore hole and the diameter variations thereof are known, and by making use of the tools of a small size.

For highly inclined wells, it has been proposed in U.S. Pat. No. 4,168,747 to place in the well a flexible line provided at one end thereof with a head producing fluid jets which aid the progress of the flexible line through the well. The tool is introduced into the flexible line and its displacement is obtained by pumping the fluid filling the well and the flexible line. The tool which is maintained permanently inside the flexible line is, accordingly, necessarily of a type whose operation is not disturbed by the presence of the flexible line, for example, a neutronic or $\gamma$-ray sonde for measuring the characteristics of the formation.

Such a solution suffers from a number of drawbacks. As a matter of fact, not only it is not usable with all the tools which may have to be introduced into the well, such as an electric or electro-magnetic sonde, but its operation is time consuming. Moreover, the unavoidable friction of the flexible line against the wall of the well, particularly in the highly inclined portions, requires, for its progression, very powerful jets which locally damage the bore-hole wall. Such a device cannot therefore be used for introducing tools in highly inclined portions of great length, and in substantially horizontal well portions.

It is also known to adapt a tool such as a measuring sonde at the end of a substantially rigid hollow string so as to move it by the action of a thrust exerted on the string.

The disadvantages of this solution result from the fact that the tools placed at the end of the string rub against the wall of the well and may be damped. On the other hand, these tools are connected to the surface through a control and measurement signal transmission cable which is housed in the bore of the hollow string, thereby making substantially more complex the assembling of the end-to-end screwed elements forming the string.

In order to reduce the latter disadvantage, there can be used a special sub generally called in the art "Side Entry Sub" and described, for example, in U.S. Pat. No. 4,062,551.

The screwing or unscrewing of the string sections above this special sub is simplified in view of the fact that above this sub, the cable is external to the hollow string. Nevertheless, the above mentioned disadvantage continues to exist for the string section between this special sub and the tool. Moreover, care must be taken to avoid blocking of the cable which, above the special sub, is located in the annular space defined between the hollow string and the wall of the well.

The location of this special sub on the hollow string is preferably but not limitatively selected so that, during the displacement of the string, this sub remains in the vertical section of the bore-hole wall.

U.S. Pat. No. 4,039,237 describes a drilling apparatus whereby a cable provided at its lower end with an electric connector which establishes the electric connection with a bottom electric motor which is lowered by gravity into the string.

It is also known from U.S. Pat. Nos. 3,976,347 and 4,126,848 to make use of electric connectors adapted to be lowered through a string of rods at the lower end of a cable for being connected to devices located at the bottom.

Such devices cannot be used to effect operations in highly deviated wells.

Furthermore it is necessary in some cases to rotate the tool about its axis, for instance when said tool is a density nuclear logging tool which requires that the sensitive pad be applied against the ground formation or formation tester or oriented perforating guns . . . , or for instance, when said tool is a four arm caliper intended to determine the cross sectional geometry of the hole. It is often desirable that the angle of rotation be precisely controlled and that the rotation be of an easy and reliable use for the tool itself and for the other components, e.g., the string, the electric cables . . . , etc.

SUMMARY OF THE INVENTION

It is an object of the present invention to provide a method and an apparatus which does not suffer from the disadvantages of the prior art and makes possible effecting operations, by means of specialized tools, in portions of wells highly inclined to a vertical line and which may be so inclined as to be substantially or completely horizontal.

According to the invention there is provided a method for effecting logging or servicing operations in a predetermined zone of a bored hole having, from the surface of the earth, an initial portion followed by an inclined or horizontal portion, said predetermined zone being located beyond the initial portion of the well, and said method comprising the following steps of:

securing a logging or servicing tool body at the lower portion of the first rod of a string, said tool body being electrically connected to a first electric connector integral with said first rod and of easy accessibility from the upper part thereof, assembling the string by end-to-end connection of additional drill rods above said first rod, and progressively lowering into the well the assembly of the tool body and of the string of rods, as the latter is assembled, introducing into the string of rods, from the surface, a second plug-in electric connector for use in liquid medium, said second connector being mechanically secured to the lower end of an electric transmission cable and electrically connected to the surface through said cable.

The method of the invention is characterized in that said second connector, secured to the cable and weighted, is lowered into the string of rods when the tool body substantially reaches said predetermined zone of the well. This is accomplished by making the cable slide through a sealing member which is secured to the string of rods at the surface, and the second connector is moved through said inclined or horizontal portion of the string of rods by pumping of a fluid through the string of rods from the surface until said second electric connector joins said first connector. The tool body being positioned in said predetermined zone of the well, the tool is rotated without rotating the whole string of rods, and the logging or servicing operation is then effected in said zone.

The initial portion may be vertical or of any inclination.

According to a preferred embodiment, a pressure pulse is generated in the first rod when said second connector reaches the immediate vicinity of said first connector, so as to generate a sufficient force to urge the two connectors towards each other and to join them.

In accordance with the invention there is also provided a device for effecting logging or servicing operations by means of a specialized tool, in a predetermined zone of a bore hole. The device comprises in combination, a hollow rigid string at the end of which is secured the tool, a first electric connector connected to the tool, a string of rods connected to the upper portion of said rigid string, and an electric cable provided at its end with a second electric connector which is complementary to the first connector. The device is characterized in that the string of rods comprises at its upper portion a sealing member wherethrough the cable may slide, and said second connector is weighted and provided with operating members for its displacement under the action of the fluid pressure inside the string of rods. Furthermore, the device according to the invention comprises rotating means for allowing rotation of and/or for rotating the tool without rotating the whole string of rods. This rotating means may be located between the string of rods and said tool.

The device preferably comprises means for a relative positioning of said first and said second connectors, including the combination of a conical shoulder of the second connector, cooperating with a corresponding seat arranged in the internal wall of the rigid string, and a system for hooking the two connectors, forming a top stop member above the conical shoulder and its seat.

Preferably, said members for operating the displacement of the second connector comprise annular cups whereon acts the fluid pressure, these cups being of a diameter smaller than the internal diameter of the string of rods. In addition, an inner tubular lining, locally reducing this internal diameter so as to generate a triggering pulse, is located in the rigid string at a level slightly above that of the cups in the coupled position of the two connectors.

BRIEF DESCRIPTION OF THE DRAWINGS

The invention will be better understood and all of its advantages will be made apparent from the following description, illustrated by the accompanying drawings wherein:

FIG. 1 shows a tool secured to the end of a rigid tubular string;

FIGS. 2 through 6 illustrate the operation of the invention;

DETAILED DISCUSSION OF THE INVENTION

The tool diagrammatically shown at 1 in FIG. 1, is mechanically sheltered in a casing 2. The so-formed assembly is secured to the end of a rigid tubular string 3, made up of end-to-end screwed elements. One of the elements 4 of a tight plug-in electric connector is connected to the tool 1.

By tool it is meant here any device or operating member which is to be introduced into a bore hole to effect such operations as the determination of at least one characteristic of the formations (e.g., resistivity, acoustic impedance, measurement of the sound propagation velocity through the formations, $\gamma$ rays natural transmission, absorption rate of certain radiations, etc.), operations for controlling the cementation of a tubing in the well, location control of the joints between the elements forming the tubing, control of the exact orientation of the well, or such operations as tubing perforation, taking of solid samples of the wall of the well, collecting liquid samples into the well or dipmetering operations, this list being by no way limitative.

Of course, the shape of the casing 2 is determined by those skilled in the art in relation with the type of tool involved and may, in addition, provide for a thermal protection of the tool by circulation of a fluid such as drilling mud which usuall fills the bore hole.

Figure 9:
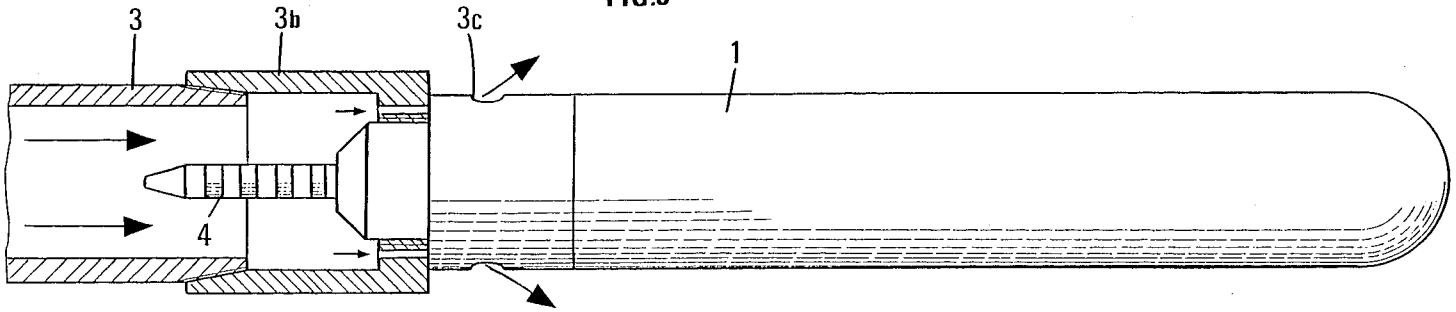
FIG. 9 illustrates the example of a tool directly secured to the end of a rigid tubular string.
Figure 12:
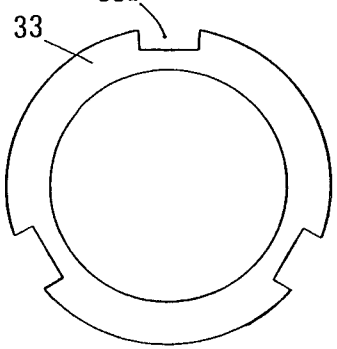
FIG. 12 shows a hooking ring after shearing thereof.

In the embodiment shown in FIG. 9, this fluid flows through openings **3*c* arranged in the connector member 3*b* beyond the electric plug 4. This opening may be located on the lateral wall just above the tool or at the end of the sheltering casing 2 (FIG. 1**).

The method according to the invention comprises the steps of fastening the assembly of the tool 1 and its sheltering casing 2 at the end of a hollow rigid string 3, without however, connecting the tool to a cable for supplying power and/or transmitting informations. Thus, the tool is in an inert state where it is not likely to be actuated inadvertently, by wrong moves or by parasitic signals. This constitutes a sécurity, in particular, for the tools comprising explosive charges which must be actuated only when the tool is at a predetermined location in the well. Moreover, it will be observed that the absence of a transmission cable makes it easier to effect the end-to-end connection of the elements forming the string 3.

Figure 6:
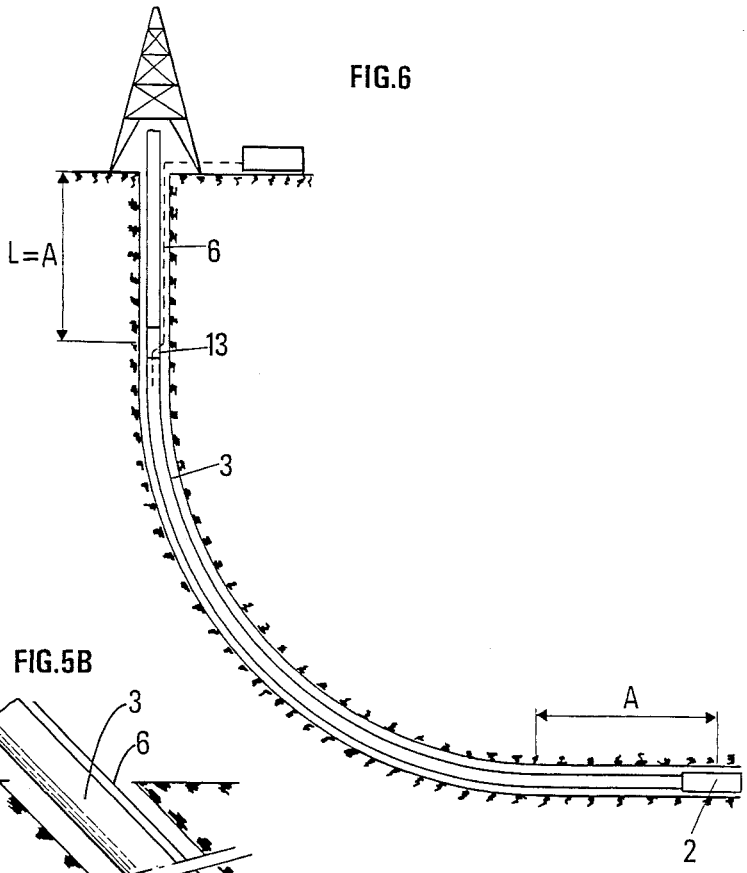

Through column 3, the tool 1, sheltered by its casing 2, is introduced and moved into the well (FIG. 2) down to the desired position which is the exact position, at which the tool must operate in the case of a tool used for only one separate operation, or which is at the farthest end from the surface of a length portion A along which the tool has to operate (FIG. 6). The length of portion A is preferably, but not limitatively, at most equal to, the length of the well section L which is generally vertical, if any portion is vertical, and extends from the surface.

For connecting the tool to a cable supplying power and/or transmitting informations, there is used a plug-in electric connector adapted to be used in a fluid medium. This connector may be of any known type and, for example, such as is described in U.S. Pat. No. 4,039,242.

This connector consists essentially of a socket and a plug, complementary of each other, and which fit together when brought in close relationship. One of them, for example, the plug 4 is connected to the tool. The other portion (socket 5) is secured to the end of a transmission cable 6.

When the tool has been located in the well, as above indicated, the socket 5 and cable 6 (FIG. 3) are introduced into the hollow string 3. A heavy element or weighting bar 7 overtops the socket 5 and facilitates its movement through string 3 under the action of gravity. Then, by pumping fluid through string 3, the socket 5 is displaced until its connection with plug 4 is effective. This connection may be easily controlled, for example, by means of contacts closing an electric circuit when the plug 4 is correctly engaged into socket 5. A locking device of any known type maintains the socket and the plug in their position of engagement.

In the case where the tool must only operate at a predetermined location of the well, the introduction of the socket 5 and of cable 6 into the string 3 and pumping operation may be effected by making use of a blow out preventer (B.O.P.) well known in the field of drilling and diagrammatically shown at 8 in FIG. 4. This B.O.P. comprises jaws 9 and 10 which are readily displaceable, and which maintain the seal about cable 6. The fluid is circulated by means of a pump 11 communicating through a valve 12 with the interior of the rigid string 3.

In the case where the tool has to operate along a portion of the well, the cable 6 is preferably introduced in the string 3 through a special sub 13 having a lateral port, generally called "side entry sub". This sub is secured to the top of string 3 as shown in FIG. 5 as soon as the sonde enters the zone to be explored (FIG. 2). It is preferably provided with means for tightening the cable in order to rigidly position the latter at the sub level after connection of plug 4 with socket 5.

Once the electrical connection of the tool has been effected by the plug-in connectors 4 and 5, the displacement of the tool 1 down to the end of the zone to be explored is obtained by adding rigid elements above the sub 13 (FIG. 6) over a length L equal to the length A of the zone to be explored.

Figure 5A:
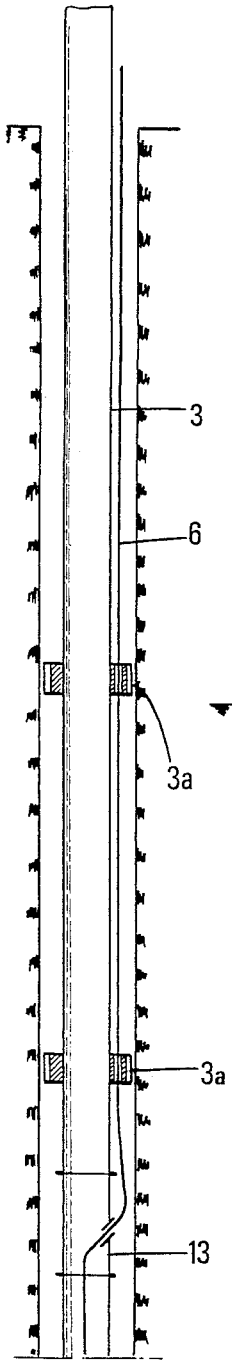

Optionally, as shown in FIG. 5A, rubber centering members 3*a*, secured to the rigid string, guide the cable 6 over a certain distance along the drill string 3 above the side entry sub 13.

Figure 5B:
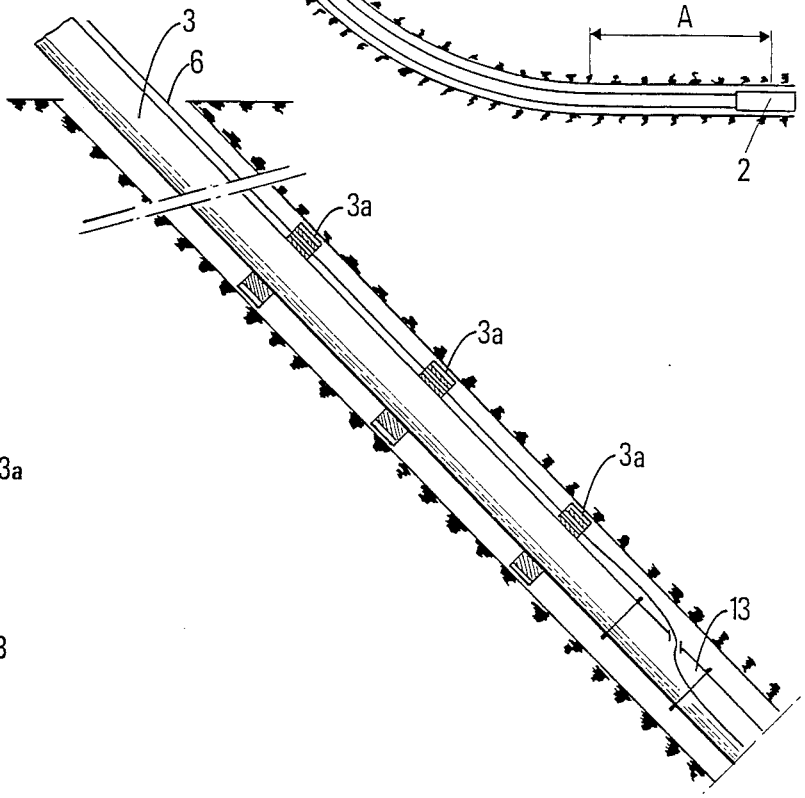

The use of such centering means is particularly recommended, but not compulsory, when the first portion is inclined or horizontal; see FIG. 5B.

These centering members may be of any known type and particularly of the type solid by the WEATHERFORD-STABILIA Company under the name "Control line".

The tool 1 is operated by remote control through the transmission cable 6, this operation being performed over the portion A of the well by progressively raising up the string 3. This raising up operation of string 3 is made easier by the fact that the cable is, at the surface, external to the string 3, which facilitates unscrewing of the tubular elements of the string.

The sub 13 may be of any known suitable type and, particularly, of the type described in U.S. Pat. No. 4,062,551.

During their operation, certain tools must be accurately centered into the well. This may be obtained by centering members 14 secured to the casing 2 and optionally to the string 3 as diagrammatically shown in FIG. 7. These centering members are for example of the leaf type, well known in the art of earth drilling. Other types of centering members may also be used, for example, centering members of rubber with mud passage.

Figure 8:
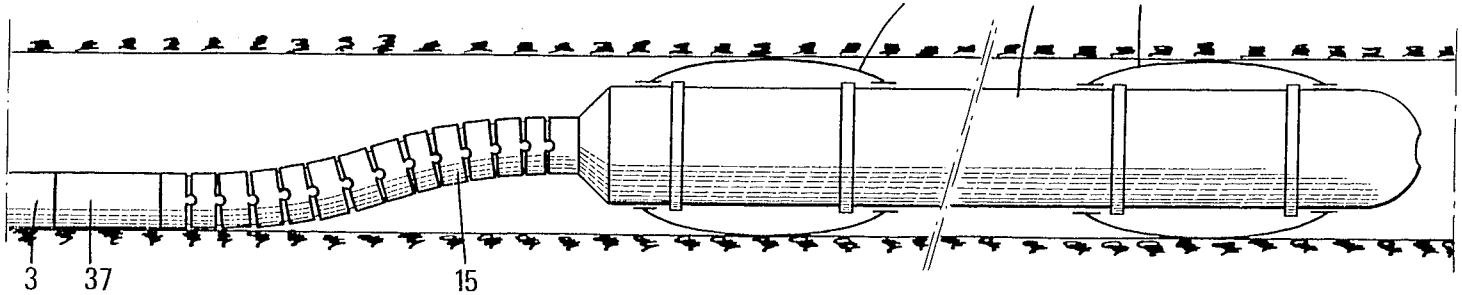

According to an embodiment illustrated in FIG. 8, the tool 1 and its casing are connected to the end of the rigid string 3 through a portion of deformable tube 15 formed, for example, of tubular rings or rod portions articulated with respect to each other. Such deformable rod portions are well known in the art and sold, for example, by ARCO DRILLING Company under the trade name "KNUCKLE JOINT".

In this case, only the casing 2 is provided with centering members 14 for maintaining the tool substantially co-axial with the well.

In order to operate under good conditions, certain tools must be disengaged from their sheltering casing 2. This is the case, for example, of electric measuring sondes known under the trade name of laterolog or "dual" laterolog, of the acoustic measuring sondes type, etc.

The tool may be disengaged from its casing by any known device such as, for example, a piston integral with the tool and sliding into the casing. By injection of a hydraulic fluid such as mud, the piston is displaced to disengage from the casing the active part of the tool or to retract the tool into its sheltering casing.

Figure 10A:
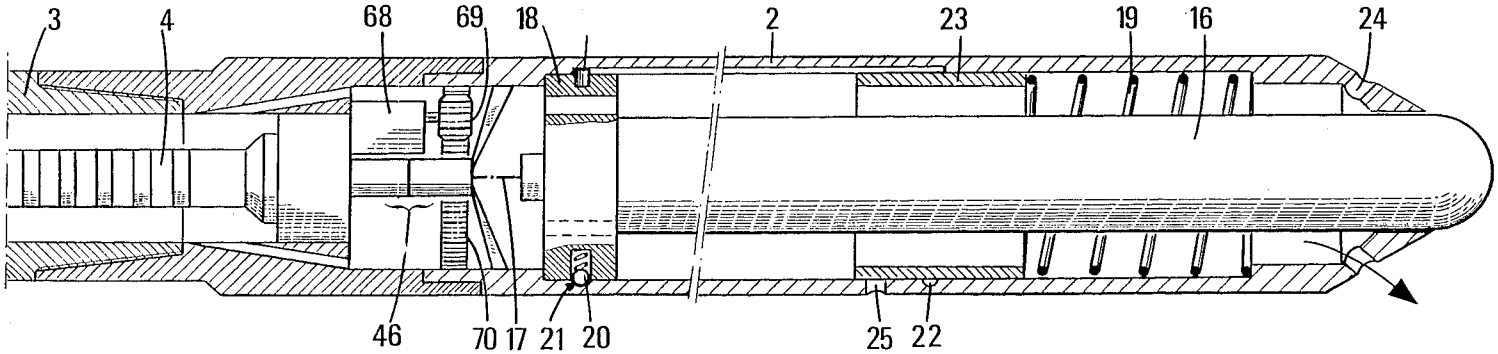
FIGS. 10A and 10B diagrammatically illustrate an embodiment of the invention making use of a tool which can be disengaged from its housing by remote control.
Figure 10B:
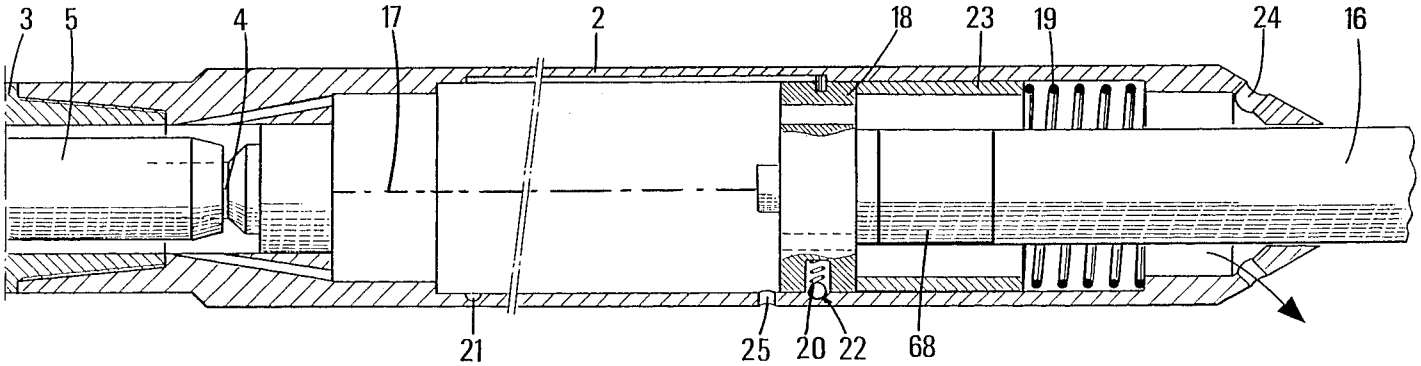

FIGS. 10A and 10B diagrammatically illustrate such an embodiment and its operation. In the example illustrated by these figures, reference 16 designates the active part of the tool electrically connected to the male connector 4 through an extending electric cable 17 and fixedly secured to a piston 18 slidably mounted inside casing 2. The assembly 16-18 may slide from a retracted position of member 16 shown in FIG. 10A to the position illustrated in FIG. 10B wherein the active part 16 of the tool projects outside the end of casing 2, as a result of an overpressure of the fluid injected into the string of rods, while compressing a return spring 19. The piston 18 is provided with a member 20 adapted to lock it in one or the other of its two limit positions by cooperation with slots 21 and 22 provided in the wall of casing 2. Through piston 18 are arranged channels allowing the flow of the drilling fluid. The member 20 may be, for instance, an electromagnetic element or a mechanical one.

In the position of FIG. 10A, this fluid escapes through ports 24 arranged at the end of casing 2, whereas lateral ports 25 are obturated by a ring 23.

When passing to the position illustrated in FIG. 10B, this ring 23 is pushed to the right by piston 18 and uncovers the ports 25 through which the fluid may also escape (as a result a pressure drop of this fluid occurring, whereby it is possible to ascertain at the surface that the active member 16 has reached in its working position).

Certain tools, such as tools with pads of the density, microresistivity, micro-acoustic measuring type and certain perforators with explosive charges, need to be oriented in the well before their operation in order to improve their performance. Moreover, the orientation of the tool is an additional parameter to that of the measurement. The combination of these two informations in highly deviated and horizontal wells improves the interpretation of the results. This may be the case for detecting fractures of the formation and for determination of the tubing cementation.

For this purpose, casing 2 may contain an orientation sensor such as at least one accelerometer or a gyrocompass.

For example, the use of a single accelerometer having the same axis of rotation as the tool makes it possible to position a previously identified generatrix of the tool in a vertical plane passing through the tool axis.

The combined use of two accelerometers, whose axes of rotation are perpendicular to each other, and to the tool axis, makes it possible to measure the angle formed between a vertical line and the plane containing the previously identified generatrix and the sonde axis.

Thus, the string 3 may be driven in rotation from the surface in relation with the indications supplied by these sensors, so as to accurately position the tool in the well.

However, these methods present some drawbacks among which are included:

- It is difficult to precisely control the angle of rotation because of the friction forces along the string of rods, these forces requiring the application of an important torque at the surface.
- It is necessary to make many complete rotations of the string of rods about is longitudinal axis at the surface before inducing the rotation of the tool.
- When rotation of the tool occurs it is often brutal and cannot be controlled with precision.
- Furthermore, it is difficult to rotate the string of rods from the surface because of the electric cable which is outside the string of rods. This makes unusable the kelly bar and the rotary table, and
- It is insecure to rotate the whole string of rods from the surface.

Figure 7:
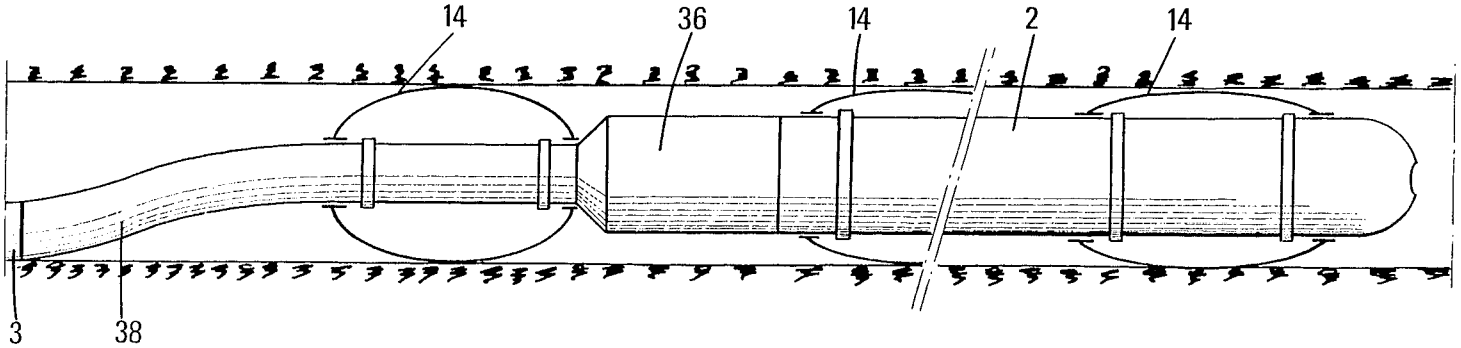
FIGS. 7 and 8 show the centering of the tool and of its casing into the bore hole.

In FIG. 7 reference 36 designates rotational means which allow rotation of the tool. Said means are located beyond the deformable part 38.

In FIG. 8 the rotational means 37 are located before the deformable tube 15. It is possible to reverse the locations of the rotational means between FIGS. 7 and 8.

Modifications may be made without departing from the scope of the present invention, in particular as shown in FIG. 9.

For example, when making use of certain tools such as a tool for taking samples of liquid in the well, or a tool for perforating a tubing secured onto the wall of the well, these tools being of a type called in the art "gun" or "scallop", the casing may be integral with the tool itself or may even be omitted. In such a case, the tool 1 will be directly secured to the end of the string 3 by means of an intermediate sub **3*b* provided preferably with ports 3*c*** for the fluid passage.

It is obvious that the tool used according to this invention may comprise a device for measuring the strength or force exerted on the tool. This is particularly useful when the tool is not housed in a sheltering casing. This device may be activated once the electrical connection is operated.

Figure 11A:
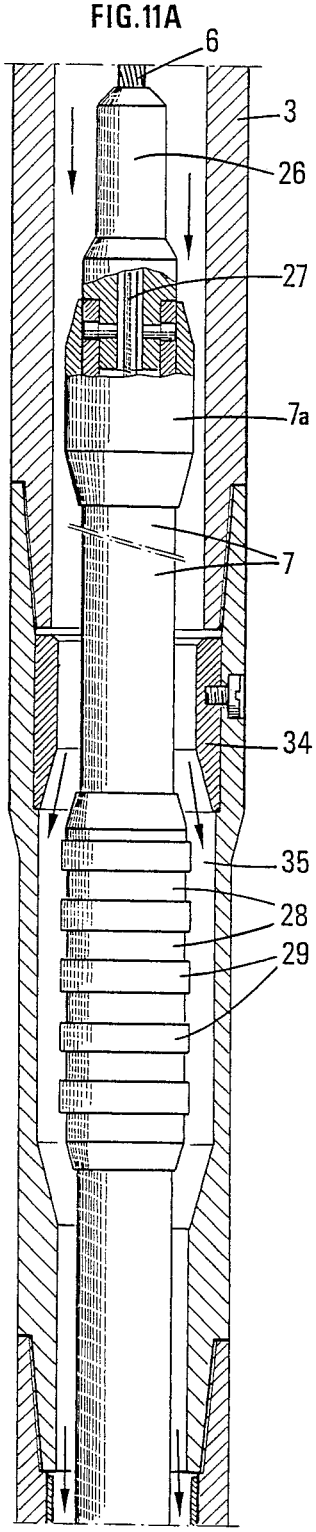
FIGS. 11A and 11B respectively show the upper portion and the lower portion of the assembly formed by the weighting bar and the female electric connector, in position of connection with the male connector.
Figure 11B:
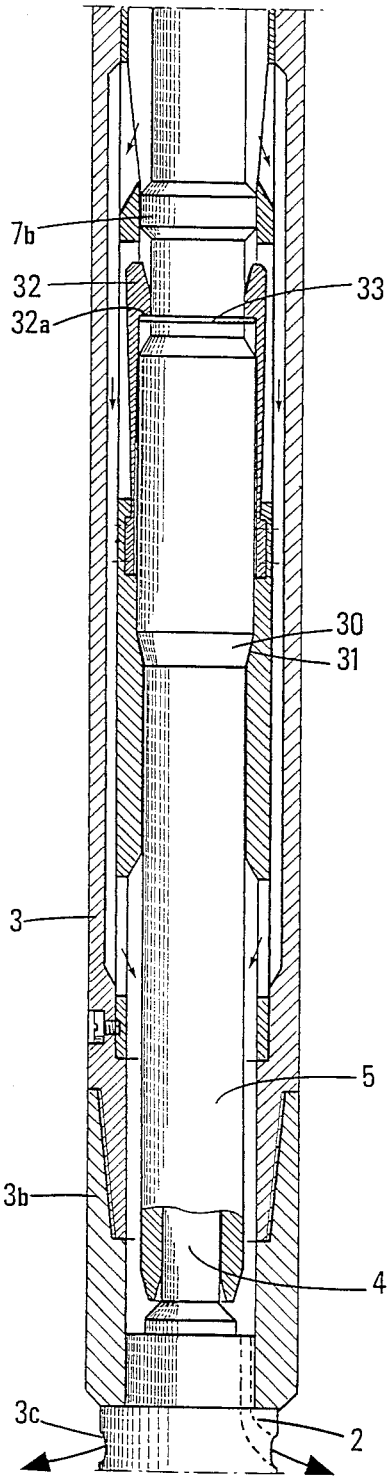

FIGS. 11A and 11B respectively show the upper portion and the lower portion of the assembly formed by the weighting part 7 and the female connector 5, in the position of connection of this assembly to the male connector 4 housed at the bottom of the string of rods 3, above the tool 1. The arrows show the flow of the fluid injected from the surface which escapes through ports **3*c* above the casing 2 (FIG. 11B) or above the tool 1 (FIG. 9**).

A joint 26 provides for the electric connection of conductors 27 of the cable 6 with the female connector 5.

The assembly 5-7, mechanically connected to the joint 26, comprises two centering members **7*a* and 7*b* and a sleeve 28 carrying annular cups 29 (for example of elastomer) of a diameter smaller than the internal diamter of the string of rods 3, which act as a series of pistons whereby the assembly 5-7** is moved by the fluid under pressure though the inclined portions of the well.

An accurate and reliable positioning of the female connector 5 with the male plug 4 is obtained by the combination of:

(1) a conical shoulder 30 of the female connector cooperating with a corresponding seat 31 arranged in the internal wall of the element of the string of rods wherein the socket 5 penetrates, (2) a hooking system placed above the assembly 30-31, said system preferably comprising at least one shearable hooking ring 33 rigidly secured to the female socket 5 and a plurality of hooking and retaining electric fingers or leaves 32, arranged inside the element of the string of rods and integral therewith (in the illustrated embodiment, three leaves are provided at an angular interval of 120°).

The hooking ring 33 being engaged under the retaining faces **32*a* of the fingers 32 by an interlocking or triggering pulse generated by the fluid pressure, (the way of producing this pulse will be indicated more precisely hereinafter), the socket 5 is then accurately positioned between a lower stop face or seat 31, (whose level corresponds to a perfect electric connection between elements 4 and 5), and the upper stop member formed by the retaining faces 32*a* of fingers 32**.

By applying to cable 6 from the surface a moderate traction force (lower than that resulting in the shearing of ring 33), it can be ascertained that the hooking is effective (as a matter of fact, in such a case, the traction on the cable results in an increased tension thereof).

The socket 5 may be disconnected from the plug 4 by application of a high traction, force, resulting in the shearing of the ring 33 at the level of the leaves or blades 32. This traction force must be higher than the shearing force increased by the friction force of cable 6 all along the string of rods 3. Experiments have shown that, with such a device, it is possible to effect several successive connections and disconnections without having necessarily to raise up, at each time, the ring 33 to the surface for being replaced by another one since the slots 33*a* created by the shearing during a disconnection do not register with the leaves or blades 32 at the time of a new connection.

The ring 33 may however, be easily replaced at the surface after raising up the socket 5, and it would be desirable to supply or make available sets of rings of different shearing strengths to be selected in accordance with the tensile strength of cable 6.

The fluid pressure pulse producing the interlocking of ring 33 with the retaining leaves 32, and consequently, of the plug 4 with the socket 5, is obtained by placing in the string of rods, at a level slightly above that occupied by the cups 29 in position of connection of elements 4 and 5, a tubular lining 34 having a reduced inner diameter which is only slightly greater than the external diameter of the cups 29, so as to produce an abrupt increase of the downward axial thrust acting on the cups when the latter passes through the tubular lining 34, slightly before the connection.

This triggering pulse is sufficient to produce the interlocking of ring 33 with leaves 32.

At the output of the tubular lining 34, the cups 29 penetrate into a chamber of larger diameter, wherethrough the fluid can easily flow around the cups.

The respective diameters of the cups 29 and of the tubular lining 34 may be changed at will.

It is obvious that other equivalent means can be used to lock the plug 4 to socket 5, for instance, electrical, mechanical or electrohydraulical devices, said devices may be controlled from the surface.

The above-described devices according to the invention make it possible to establish at will a continuous or periodical circulation of fluid around the tool in course of operation.

This circulation is particularly advantageous for the security of the well, for cleaning the hole, for facilitating the movement of the string of rods in the well and/or for cooling the tool, if used in a hot formation, and/or for cooling the formation itself.

The technique of the invention is accordingly of particular interest for operating a television camera used for observing the wall of a well, for example, through a viewport arranged in the wall of casing 2. As a matter of fact, in this case it is possible to circulate, through the string of rods, limpid water which clears the field of the camera lens and ensures cooling thereof during its operation.

The rotating device may be of the same type as the one described in U.S. Pat. No. 4,286,676 but without inducing an angle other than 180° between the two tubular members illustrated in this patent. According to the present invention one of these tubular members will be integral in rotation with the string of rods and the other will be integral in rotation with the tool.

Figure 13:
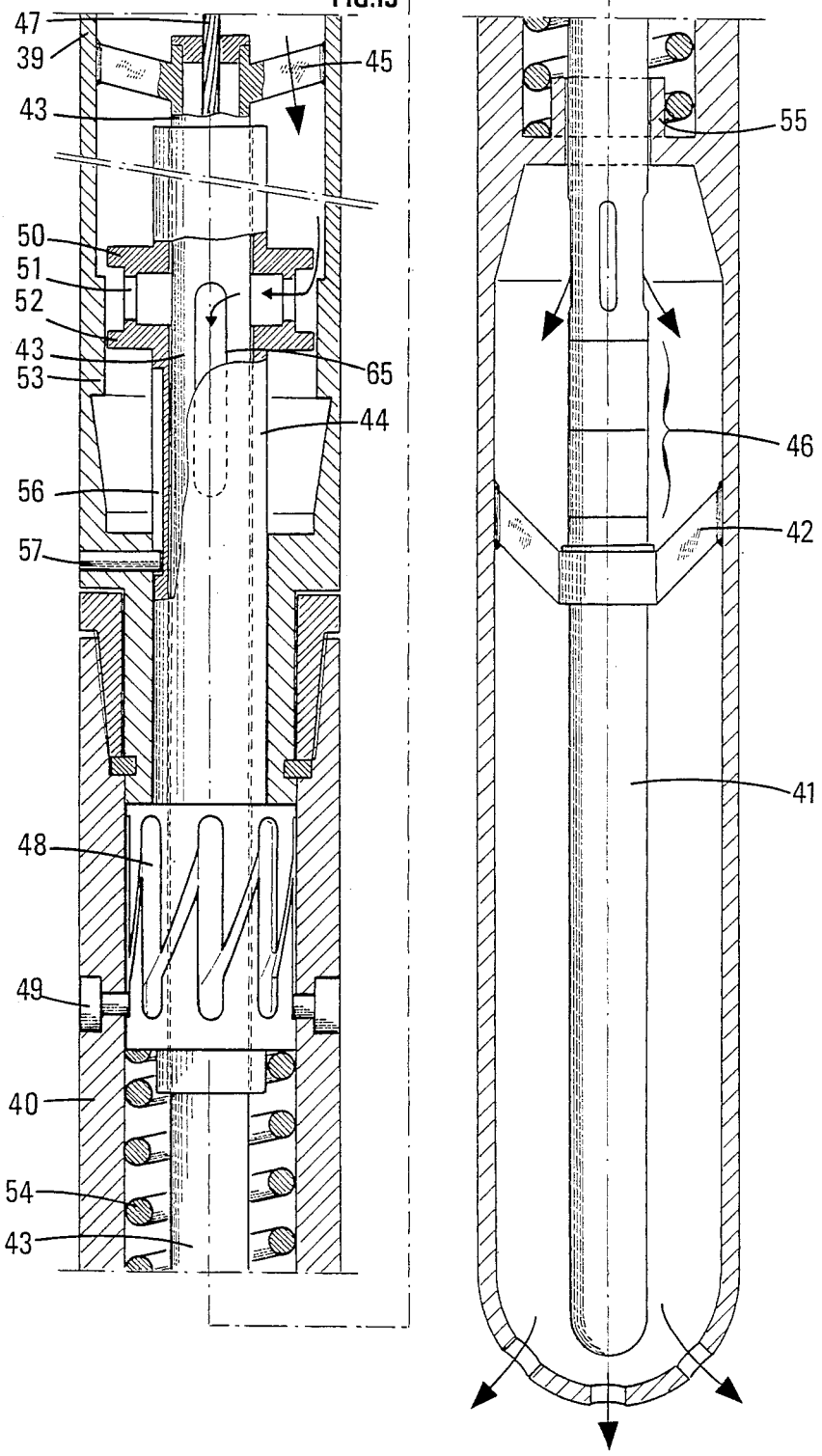
FIGS. 13, 14A and 14B diagrammatically illustrate embodiments of the means for rotating the tool.

FIG. 13 shows another embodiment according to which a first part 39 is integral, at least in rotation, with the string of rods, and a second part 40 is integral with the tool 41 via linkage 42.

Inside part 39 and 40 there are two coaxial tubular elements 43 and 44. The first tubular element 43 is integral with the part 39 via a linkage 45 and carries a swivel connector 46 ensuring electric connection between the tool and the first end of an electric cable 47. The other end of this cable is to be connected with the end of the transmission cable 6 via the socket 5. Thus, the plug 4 will be remote from the tool. The second tubular element 44, which surrounds the first one comprises at one of its extremities a groove 48 which cooperates with at least one finger 49 provided on the part 40. This groove may be of the type described in U.S. Pat. No. 4,286,676. A portion, at least of this groove, may be inclined relative to the axis of the said second part 44. Preferably the groove is positioned so that the tool 41 rotates when the second tubular element 44 is lowered, for instance by increasing the pressure of a fluid from the surface. This fluid will exert a force on a piston 50 located on said second tubular element 44 at its second end. The second element 44 may comprise a second piston 52 and an opening 51 for allowing the circulation of said fluid via a second opening 65 made on said first element 43. The pistons 50 and 52 cooperate successively with a bore 53 arranged inside the part 39. At rest, the piston 52 is located inside said bore. When the fluid flow rate is lower than a certain value determined by the stiffness and the initial compression of a spring 54 which cooperates with an abutment 55 and which tends to force back the second element 44, nothing moves. When the fluid flow rate increases, the fluid exerts enough force on the piston 52 to move the second element downwardly. Then the first piston 50 cooperates with the bore 53. Upon this moment the opening 51 is no longer in communication with the fluid and the force exerted on the first piston 50 increases enough to make the part 40 and the tool rotate. When the second element is in its lowermost position the opening 51 communicates again with the fluid and allows circulation thereof. When the fluid flow rate is interrupted the spring 54 urges the second element back to its rest position.

The first element 43 has an opening which allows circulation of the fluid through the opening 51.

Furthermore, the second element comprises a groove 56 which cooperates with a guide finger 57, and these two last-mentioned pieces prevent the rotation of the second element relative to the part 39.

Figure 14A:
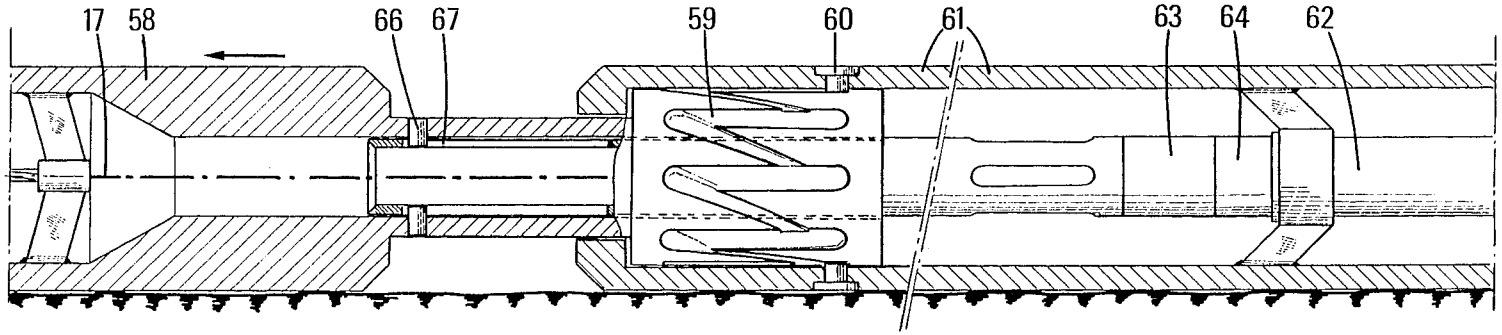

FIGS. 14 and 14A show another embodiment. According to this embodiment a part 58 is integral in rotation and in translation with the string of rods 3. This part 58 comprises grooves 58 like those described herein before, but preferably arranged in an opposite direction, i.e., so as to rotate the tool when it is pulled out. These grooves cooperate with at least one finger 60 provided on a second part 61 which may rotate around the first part 58 and may also be axially translatable relative to said first part. The tool 62 is integral at least in rotation with said second part 61. The first part 58 is integral in rotation, but not in translation, with the first element 63 of a swivel electrical connector. This may be achieved by means of a finger 66 located on said first element of the swivel, with this finger cooperating with an axial groove 67 provided in the first member 58. The first element 63 of the swivel cooperates with a second element 64 of said connector located on the tool 62. These two elements may rotate, one relative to the other. An electrical extensible cable 65 joins the first element 63 of the swivel connector to an electrical plug, said plug cooperating with the socket 5.

Figure 14B:
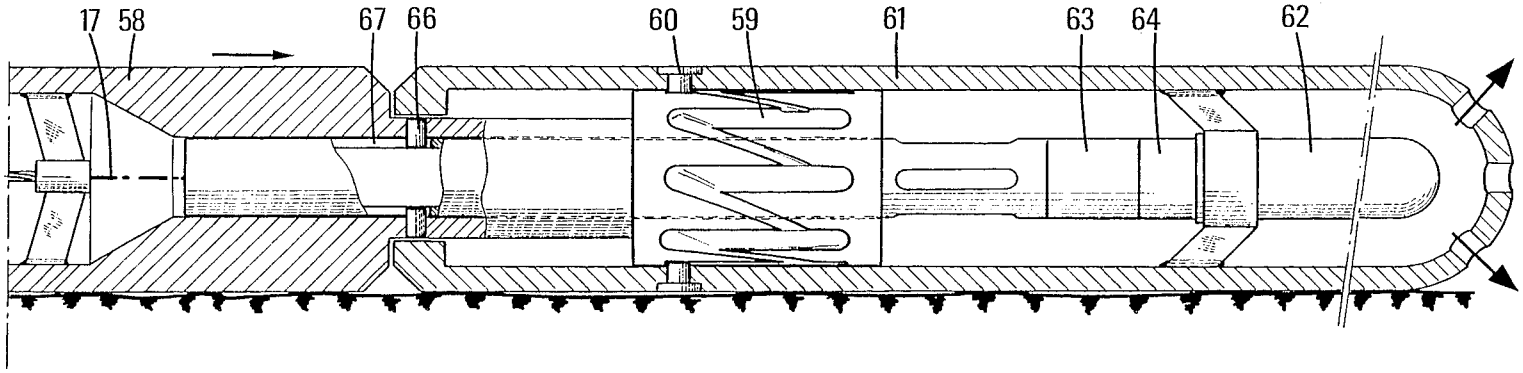

To rotate the second part 61, and thus the tool 62, the string of rods is pulled out from the surface and the parts 58 and 61 are displaced from the position shown in FIG. 14A to the position shown in FIG. 14B inducing the rotation of the part 61. Then the string of rods may be pulled down.

It is obvious that the embodiment of FIGS. 10A and 10B may be combined with the embodiments of FIGS. 13, 14A and 14B:

Furthermore it is also obvious that other devices may be used to induce the rotation of the tool, for instance, by using an electric motor 68 directly coupled with the tool (FIG. 10B) or via gears 69 and 70 (FIG. 10A), or coupled with a pump for setting into operation a part like the second element 44 of the embodiment shown in FIG. 13.

Furthermore, there are other devices which are capable of converting a translational movement into a rotational movement, for instance, a member having an alternative translational movement, said member comprising at least one helical groove cooperating with fingers of an intermediate part which moves only in rotation, thus the intermediate part has a rotational alternating movement. This part may be equipped with ratchet pawls cooperating with a drive ratchet. Thus, the alternative translational movement of the part having at least on helical groove is converted into an alternating rotational movement of the intermediate part which in turn causes a succession of rotational movements of the drive ratchet. The drive ratchet is integral in rotation with the tool.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A method for effecting logging or servicing operations in a predetermined zone of a bore hole having, from the ground surface, an initial portion followed by an inclined or horizontal portion, with said predetermined zone being located beyond said initial portion of the well, the method comprises the steps of, (a) fixedly securing at the ground surface a logging or servicing tool body to the lower end of a first rod of a string of rods, with said tool body being electrically connected to a first electrical connector rigidly secured to said first rod and accessible from the upper portion thereof, (b) assembling the string of rods, by end-to-end connection of new drill rods above the first rod, and progressively lowering the assembly of the tool body and the string of rods into the well as it is assembled, and in the absence of an external conduit extending within said bore hole from the ground surface to said predetermined zone, for supporting, at its lower end, said string of rods after assembled, (c) introducing a second plug-in electrical connector for use in a liquid medium, in the string of rods, from the surface, with said second connector being mechanically secured to the lower end of an electrical transmission cable and electrically connected to the surface through said cable, and with said method further comprising:

(1) lowering said second connector, secured to said cable and weighted, into the string of rods when the tool body is positioned substantially at the predetermined zone of the well, by sliding the cable through a sealing member secured at the surface to the string of rods, and with said sealing member comprising a special sub with a lateral port through which the cable is passed, and which is secured to the upper end of the string of rods;

(2) displacing said second connector through the inclined or horizontal portion of the string of rods by pumping a fluid through the string of rods from the surface in a manner so as to exert a moving force on said second connector until said second connector operatively connects to said first connector;

(3) displacing the tool through the well by adding a tubular string of rod elements above the special sub to thereby position the tool body in the predetermined zone of the well;

(4) rotating said tool without rotating the entire string of rods; and (5) effecting the logging or servicing operation in said zone.

2. A method according to claim 1, comprising effecting said logging or servicing operations with a tool having one generatrix identified as and comprising an accelerometer having an axis of rotation the same as that of the tool, and wherein, before operating the tool, the string of rods is rotated about its axis until a signal provided by the accelerometer indicates that the identified generatrix of the tool is in the vertical plane passing through the axis of the string of rods.

3. A method according to claim 1, comprising effecting said logging or servicing operations with a tool having one generatrix identified as and comprising two accelerometers having axes of rotation perpendicular to each other and perpendicular to the tool axis, and wherein the angle formed between the vertical plane passing through the tool axis and the plane of the tool axis and the identified generatrix is derived from the indications of the accelerometers, and further comprising rotating the string of rods about is longitudinal axis until the angle between the vertical plane passing through the tool axis and the plane of the tool axis and the identified generatrix reaches a preselected value.

4. A device for effecting logging or servicing operations with the use of a specialized tool, in a predetermined zone of a bore hole, comprising in combination a first hollow rigid rod at the end of which is fixedly secured the tool, and constructed such that no external conduit extending within the bore hole from the ground surface to said predetermined zone is required for supporting, at its lower end, said string of rods when said device is in use after being assembled, a first electrical connector connected to the tool, a string of rods connectable to the upper portion of said first rigid rod, and an electrical cable provided at its end with a second electrical connector complementary to the first connector for connection thereto, and said string of rods comprising: at its upper portion, a sealing member adapted for having the cable slide therethrough into the string of rods, and said second connector is weighted and provided with means for causing it to move downwardly through the string of rods by the effect of a fluid pressure generated inside the string of rods on the second connector, and wherein said sealing member comprises a special sub having a lateral port through which the cable can pass, with said special sub adapted for being mounted on the top of the string of rods, and for being displaced into the bore hole by a distance A through which said tool is to be moved in said predetermined zone, and said device further comprising rotating means for rotating the tool without rotating the entire string of rods.

5. A device according to claim 4, wherein the tool is secured to the lower end of a string of rods, through a flexible tubular portion, and the tool is provided with means for centering it in the well.

6. A device according to claim 4, wherein the tool and the lower end of the string of rods are provided with centering means.

7. A device according to claim 4 wherein the rotating means comprise a first part integral with the string of rods, a second part integral in rotation with the tool, a first tubular element integral with said first part, a second tubular element coaxial with the first tubular element and comprising a groove cooperating with at least one finger located on said second part.

8. A device according to claim 7 wherein the second element comprises two pistons between which there is an opening made on said second element, said opening cooperating with a second opening located on the first element.

9. A device according to claim 4 wherein the rotating means comprise a first part integral in rotation and in translation with the string of rods, said part having a groove, and a second part integral in rotation with the tool, said second part comprising at least one finger cooperating with said groove.

* * * * *